US007481632B1

(12) United States Patent
Sun

(10) Patent No.: US 7,481,632 B1
(45) Date of Patent: Jan. 27, 2009

(54) SCROLL COMPRESSOR WITH AN OIL PASSAGE PLUG TO LIMIT OIL FLOW

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/850,371

(22) Filed: Sep. 5, 2007

(51) Int. Cl.
*F04C 18/00* (2006.01)
*F04C 2/00* (2006.01)

(52) U.S. Cl. ..... 418/55.6; 418/88; 418/94; 418/55.1; 184/6.18

(58) Field of Classification Search ..... 418/88, 418/94, 98, 55.1–55.6, 57; 184/6.16–6.18
See application file for complete search history.

(56) References Cited

U.S. PATENT DOCUMENTS 5,810,573 A * 9/1998 Mitsunaga et al. ..... 418/55.6
6,099,278 A * 8/2000 Hugenroth et al. ..... 418/55.1
6,139,294 A * 10/2000 Haller ..... 418/55.5
6,322,339 B1 * 11/2001 Mitsunaga et al. ..... 418/55.6

FOREIGN PATENT DOCUMENTS

JP 6013569 A * 7/1985 ..... 418/94
JP 09079422 A * 3/1997

* cited by examiner

*Primary Examiner*—Theresa Trieu
(74) *Attorney, Agent, or Firm*—Carlson, Gaskey & Olds, P.C.

(57) ABSTRACT

A scroll compressor is provided with an orifice plug inserted into an oil passage. The plug has an opening which is positioned to restrict the flow of oil through the passage, and in particular at higher speeds. The opening is formed at an outer periphery of the plug, and may be positioned at a location spaced furthest from the center of rotation of the shaft.

5 Claims, 1 Drawing Sheet

SCROLL COMPRESSOR WITH AN OIL PASSAGE PLUG TO LIMIT OIL FLOW

BACKGROUND OF THE INVENTION

This application relates to a scroll compressor, wherein a plug is inserted in an oil passage extending through a driveshaft to restrict the flow of oil, particularly at higher speeds.

Scroll compressors are becoming widely utilized in refrigerant applications. In the scroll compressor, first and second scroll members each have a base and a generally spiral wrap extending from the base. The scroll members interfit to define compression chambers. A rotating shaft is driven by an electric motor to cause one of the two scroll members to orbit relative to the other. Typically, the shaft includes an eccentric pin that extends upwardly into a boss extending away from the base of the orbiting scroll member.

An oil supply passage is formed through the shaft, and is formed off-center relative to a rotational axis of the shaft. The off-center positioning causes the passage to operate as an oil pump, bringing oil from an oil sump, upwardly through the shaft, and to bearings and other contact locations.

One concern with this existing scroll compressor is that the amount of oil which is moved is dependent upon the speed of rotation of the shaft. At higher shaft speeds, it is sometimes been the case that too much oil is pumped. This is undesirable.

SUMMARY OF THE INVENTION

In the disclosed embodiment of this invention, a plug is inserted into the oil passage, to restrict the flow of oil. The restriction will be more severe at higher speeds, and thus, the unduly large amounts of oil pumped at higher speeds with the prior art will not occur. In a disclosed embodiment, the plug is formed with an opening at a location most spaced from the shaft center axis.

These and other features of the present invention can be best understood from the following specification and drawings, the following of which is a brief description.

DETAILED DESCRIPTION OF THE PREFERRED EMBODIMENT

Figure 1:
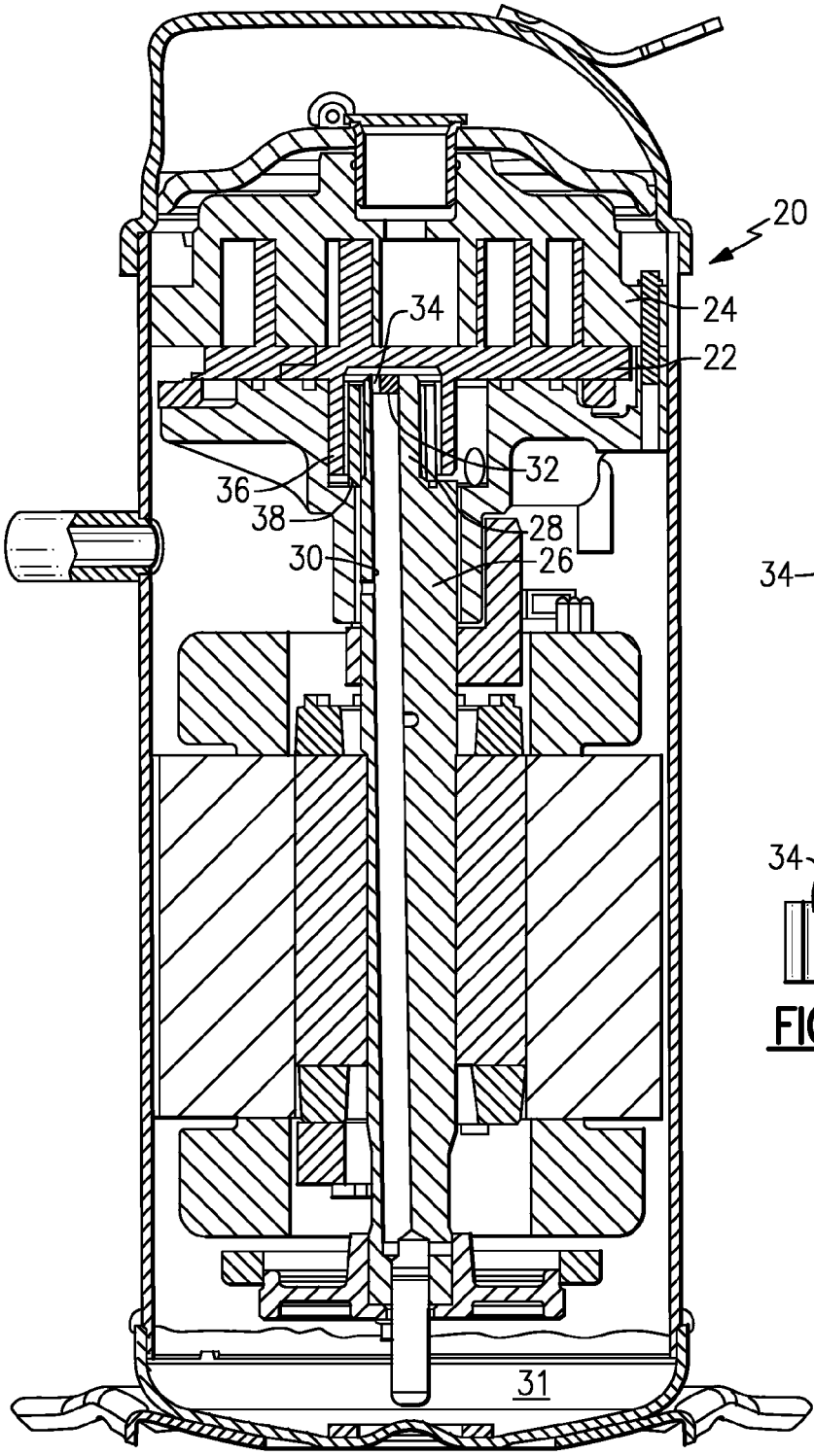
FIG. 1 shows a scroll compressor incorporated in the present invention.

FIG. 1 shows a scroll compressor 20 having an orbiting scroll member 22 and a non-orbiting scroll member 24. A shaft 26 has an eccentric pin 28 which drives a slider pin 38, all of which interfits within a hub 36 of the orbiting scroll 22. As the shaft 26 rotates, the orbiting scroll 22 is caused to orbit relative to the non-orbiting scroll 24, and an entrapped refrigerant is compressed.

During the rotation of the shaft 26, an oil passage 30 pulls oil from an oil sump 31 upwardly toward the end of the passage 30. This oil is then delivered to contact surfaces in the scroll compressor. As mentioned, with the prior art, at high speeds too much oil may sometimes have been delivered.

Thus, a plug 32 is inserted into the passage 30. The plug 32 has an opening 34 which restricts the flow of oil compared to the open passage 30. The restriction will have a greater effect at higher speeds, and thus the amount of oil delivered will be closer to an even amount, even at higher speeds.

Figure 2:
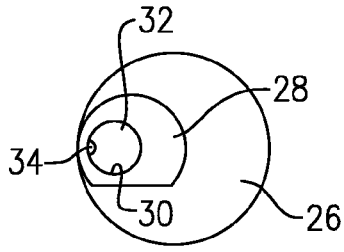
FIG. 2 is a top view of a portion of the present invention.

As shown in FIG. 2, the plug 30 has its opening 34 formed at its outer periphery, and at a location spaced furthest away from the center C of rotation of the shaft 26.

Figure 3:
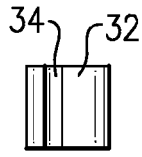
FIG. 3 shows a plug according to the present invention.
Figure 4:
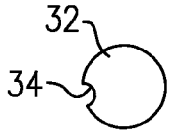
FIG. 4 shows the FIG. 3 plug.

FIGS. 3 and 4 show the plug 32 and its opening 34 formed in the outer periphery.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

first and second scroll members, each of said first and second scroll members having a base and a generally spiral wrap, said wraps interfitting to define compression chambers, a first of said scroll members being driven to orbit relative to the other, said first scroll member having a boss extending away from said base in an opposed direction to said wrap; and a driveshaft having an eccentric pin extending upwardly into said boss, and said driveshaft having an oil passage extending along the driveshaft, and being offset relative to a center of rotation of said driveshaft, said passage having an outlet end in said eccentric pin, and a plug inserted into said passage, said plug having an opening to restrict the flow of oil outwardly of said oil passage through said outlet end.

2. The scroll compressor as set forth in claim 1, wherein said plug is inserted into said outlet end of said passage and adjacent to an end of said eccentric pin.

3. The scroll compressor as set forth in claim 1, wherein said opening in said plug is positioned to be at a location spaced furthest from said center of rotation of said shaft within said passage.

4. The scroll compressor as set forth in claim 1, wherein said opening is formed at an outer periphery of said plug.

5. A scroll compressor comprising:

first and second scroll members, each of said first and second scroll members having a base and a generally spiral wrap, said wraps interfitting to define compression chambers, a first of said scroll members being driven to orbit relative to the other, said first scroll member having a boss extending away from said base in an opposed direction to said wrap; and a driveshaft having an eccentric pin extending upwardly into said boss, and said driveshaft having an oil passage extending along the driveshaft, and being offset relative to a center of rotation of said driveshaft, said passage having an outlet end in said eccentric pin, and a plug inserted into said passage, said plug having an opening to restrict the flow of oil outwardly of said oil passage through said outlet, said plug inserted into said outlet end of said passage and adjacent to an end of said eccentric pin, said opening in said plug positioned to be at a location spaced furthest from said center of rotation of said shaft within said passage and said opening formed at an outer periphery of said plug.

* * * * *